United States Patent [19]

Betts

[11] 4,411,713

[45] - Oct. 25, 1983

[54] SHELL FOR A COMPOSITE ROLL

[75] Inventor: William H. Betts, Library, Pa.

[73] Assignee: Wean United, Inc., Pittsburgh, Pa.

[21] Appl. No.: 392,098

[22] Filed: Jun. 25, 1982

Related U.S. Application Data

[63] Continuation of Ser. No. 57,156, Jul. 12, 1979, abandoned.

[51] Int. Cl.[3] ..... B22D 13/00

[52] U.S. Cl. ..... 148/35; 164/118; 164/122

[58] Field of Search ..... 164/103-105, 164/94-96, 125, 122, 124, 127, 338.1, 338.2, 164/118, 286; 148/35, 3

[56] References Cited

U.S. PATENT DOCUMENTS 1,410,885 3/1922 Cammen ..... 164/118

*Primary Examiner*—Kuang Y. Lin

*Attorney, Agent, or Firm*—Daniel Patch; Suzanne Kikel

[57] ABSTRACT

In the manufacturing of a shell for a cast iron rolling mill roll, heating the chill prior to casting so that the chill at the time pouring commences is in the approximate range of 300° to 600° F. in order to decrease the cooling rate of the metal after it passes through the solidus at a rate slower than normal to allow sufficient time through a critical temperature zone for the supersaturated solution to precipitate complex compounds in the solid solution phase. The present invention relates to a high alloy metal chemistry such as employed in the manufacture of a high chromium shell for a rolling mill roll whereby after solidification the cooling rate is decreased and controlled to allow a sufficient time through a critical temperature zone for the supersaturated solution to precipitate complex compounds in the solid solution phase. More particularly, the invention relates to a cast article and method of manufacturing by preheating of a chill mold used in the casting process such as employed in casting high chromium iron rolls of the type used in a rolling mill.

9 Claims, 13 Drawing Figures

SHELL FOR A COMPOSITE ROLL

This is a continuation of application Ser. No. 57,156 filed July 12, 1979, now abandoned.

In casting unitary or single pour rolling mill rolls and shells for composite or double pour rolling mill rolls it is a well known practice to provide a chill mold in the area forming the body of the roll. This accelerates the cooling rate of the working surface of the rolls. Solidification during this acceleration period causes elongated crystalline structures to form very rapidly inwardly of the wall of the mold along the working surface. The elongated crystals form in this area a uniform, dense, fine grain structure.

It is also a well known fact that casting against chills results in non-equilibrium conditions. In particular, solidification under such non-equilibrium conditions is known to cause super-saturated solutions of the solutes to be obtained in the solid solution matrix phase. This means that there is a high concentration of the alloying elements appearing in the matrix of the roll. This super-saturation of the solute has a pronounced effect on the final transformation products that form the matrix microstructure of the roll upon cooling to room temperature.

Through experience it has been recognized that control of the acceleration of the cooling rate was of significant importance. From this, means and methods evolved to achieve the required control. However, none of these present means and methods known to the inventor with respect to as cast products allows for the control of the precipitation of complex compounds from the super-saturated solution phase.

While some attempts have been made in the past to reduce as cast residual stresses and to effect some changes in microstructure relating to cooling rates through transformation zones, these attempts through changes in cooling rates have been made by enclosing or wrapping the chill mold with insulating materials. These attempts, however, only had the effect of slowing down the cooling rate after the metal had passed through the critical temperature zone wherein the super-saturated solution precipitates to complex compounds in the solid solution phase.

It is, therefore, an object of the present invention to provide an improved metal as cast casting and a method of casting such articles in which the super-saturated solution precipitates complex compounds in the solid solution phase.

It is another object of the present invention to provide in a method of and an article of manufacturing a high alloy metal chemistry as cast shell for a rolling mill roll in which a substantially uniform microstructure from OD to ID is obtained after solidification by controlling the cooling rate to allow sufficient time through a critical temperature zone which may vary according to the type of alloy for the super-saturated solution to precipitate complex compounds in the solid solution phase.

Another object of the present invention is to provide an as cast article produced from a method designed to control the chill mold temperature to the extent that the solidification rate associated with rapid cooling is not affected until the solid solution phase is reached, at which time the cooling rate of the metal is decreased and controlled to allow precipitation of complex compounds in the solid solution phase.

More particularly, it is an object of the present invention to produce such casting by a method including heating the chill mold so that at the time the molten metal is poured into the mold, the temperature of the chill mold is in the approximate range of 300° to 600° F.

Another object of the present invention is to provide a method to obtain in such articles an equilibrium condition for the complex compounds to be precipitated in the solid solution phase, which solid upon cooling to room temperature transforms into a desirable microstructure, thereby eliminating costly and time consuming heat treatment and attending manufacture risks associated therewith.

A still further object is to provide an article of manufacture comprising a centrifugally cast outer shell for a composite rolling mill roll, said shell composed of the following known percentage range of elements: C 2.50 to 3.50; Si. 0.50 to 2.00; S. 0.100 Max.; Mn. 0.50 to 2.00; P. 0.400 Max.; Ni. 0.50 to 2.50; Cr. 15.00 to 20.00; Mo. 0.50 to 3.00; and the balance being Fe., and having in an as cast state a desirable microstructure illustrating the dispersement of said super-saturated solution precipitates forming complex compounds.

These objects, as well as other novel features and advantages of the present invention, will be better appreciated and understood when the following description is read along with the accompanying drawings and photo-micrographs of which:

FIGS. 6–9 being representative of a test roll "A" and FIGS. 10–13 being representative of a test roll "B" shown in FIG. 3.

FIGS. 1 and 2 illustrate the casting of a composite roll consisting of a shell and a core. The shell, casted centrifugally, is the portion of the roll manufactured by practicing the present invention.

Figure 1:
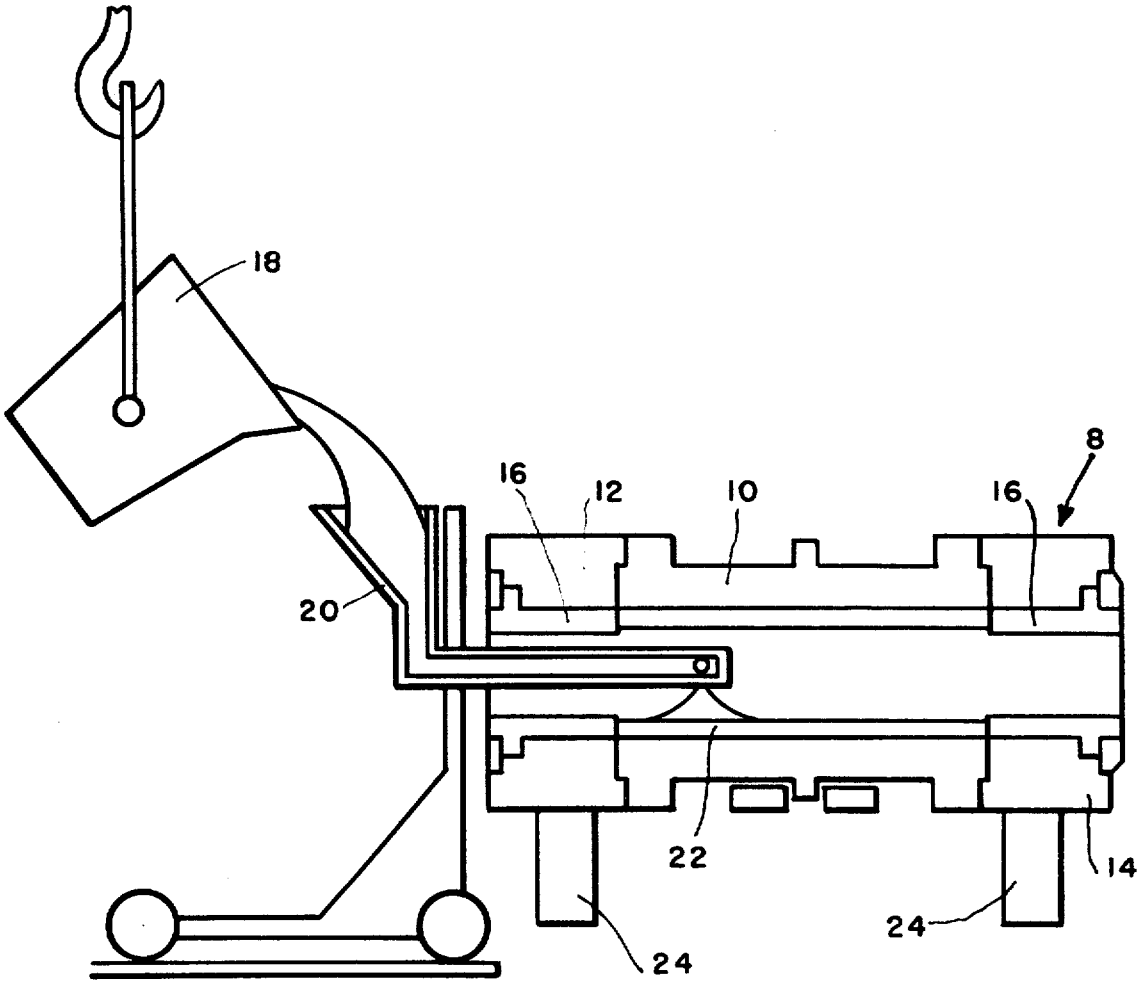
FIG. 1 is a schematic elevational view of a horizontal centrifugal casting machine used to produce a shell of a rolling mill roll having the characteristics of the present invention.

Referring first to FIG. 1, since the casting components are well known in the art it is felt necessary only to identify the main elements. The components of the mold 8 for casting a composite roll consists of a chill 10, and neck portions 12 and 14, having sand cores 16. A runner 20 extending into the neck portion 12, delivers the molten metal from a pouring ladle 18 to form a shell 22. The mold is supported by trunnions 24 and is rotated at a suitable speed. As already set forth in the objects of the present invention, the chill is employed to control the cooling rate of the metal in which the chill is heated to a temperature that will attain an approximate range of 300° to 600° F. at the commencing of the molten metal pouring stage. This can be done in several ways, but the most common practice is to appropriately heat the chill in a furnace prior to assembling the mold. Other ways contemplated would be to provide a built-in heat source in the chill itself such as electrical or fluid, wherein a very fine control of the temperature of the chill could be obtained and monitored.

Figure 3:
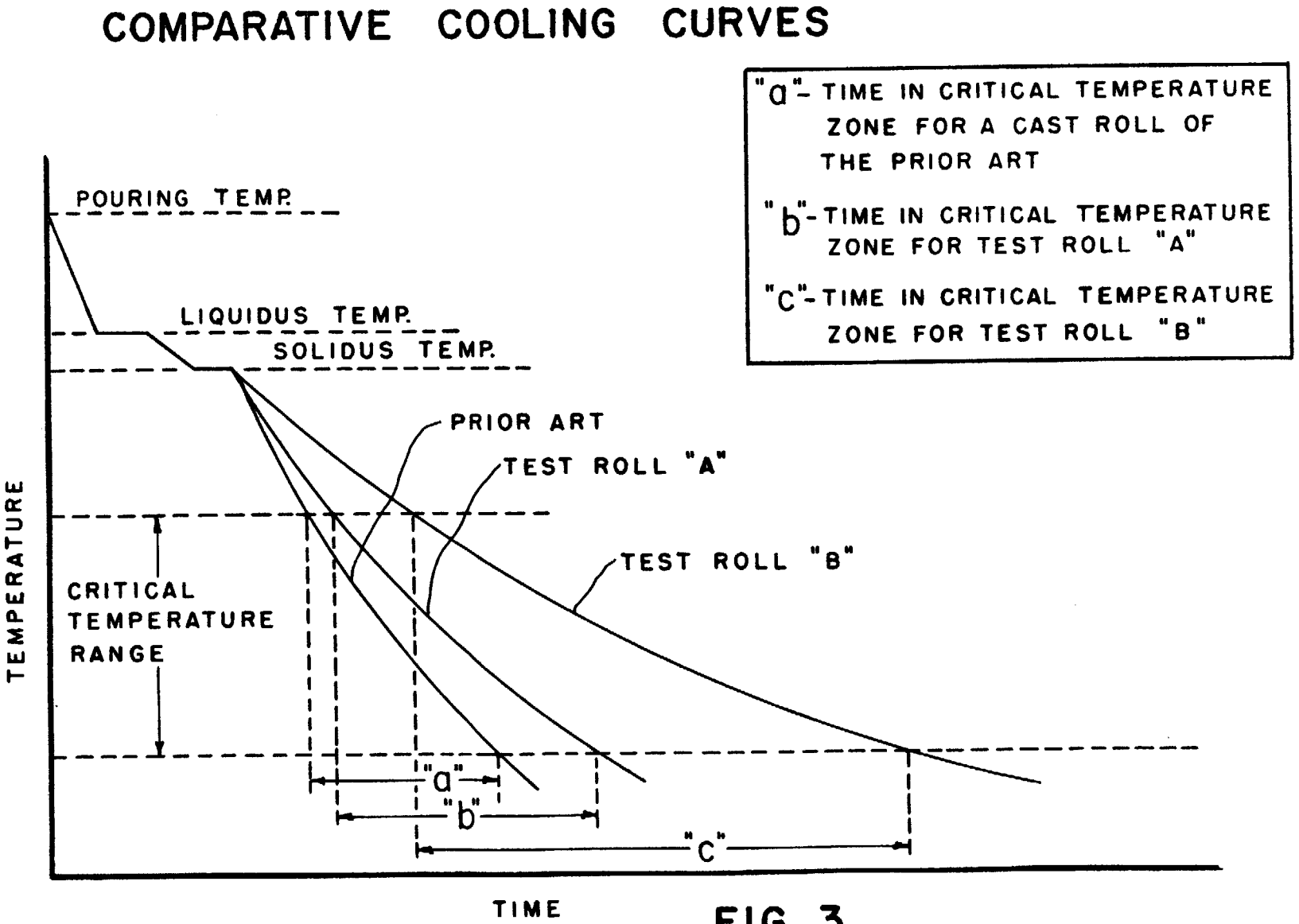
FIG. 3 illustrates cooling curves for both the prior art and two test rolls, the latter following the present invention.

And now referring to FIG. 3 which is a comparative representation of the cooling curves for a roll cast of the prior art, test roll "A" and test roll "B". All rolls represented here are of the same size and have the same chemical composition and general characteristics.

The prior art represents a roll cast in a chill at a temperature substantially below 300° F. while test roll "A" and test roll "B" were cast in chills at a temperature of 315° F. and 550° F., respectively, in accordance with the present invention.

During the metal pouring stage, as the molten metal comes into contact with the wall of the chill a chilling action of the metal occurs due to the temperature differential between the metal and the chill. Upon this initial solidification the temperature of the chill will increase; however, as pouring of the molten metal continues, a thicker wall of crystals is formed between the wall of the mold and the last layer of solidified metal causing less conduction of heat to the mold wall eventually resulting in a low rate of heat transfer between the mold and the shell.

When this low rate of heat transfer is reached the metal temperature has passed through the solidus temperature shown in FIG. 3. The fact that the chills of the present invention are at a temperature between 300° to 600° F. increases this low rate of heat transfer between the mold and the shell at a high temperature below the solidus thereby increasing the time period of the test rolls "A" and "B" on the time temperature cooling curve of FIG. 3 allowing the super-saturated solution, which inherently is unstable, to precipitate complex compounds in the solid solution phase as it cools through the applicable critical temperature zone. Since the chemical composition of the solid solution phase is now closer to equilibrium, the cooling to room temperature transforms the metal to a more desirable microstructure. While 600° F. for practical purposes is a desired temperature the upper level can be considerably above 600° F. as long as it does not adversely affect the solidification.

Figure 4:
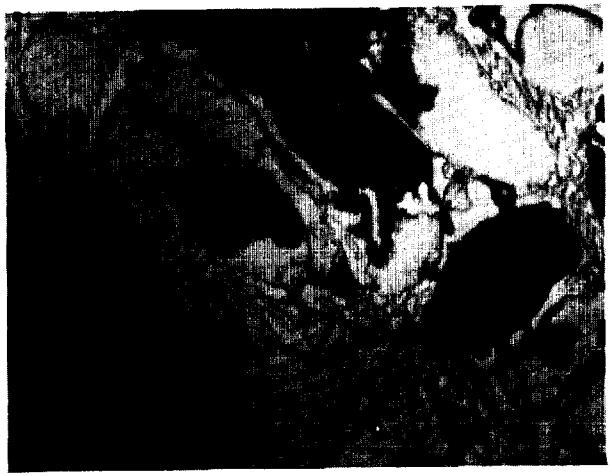
FIGS. 4 and 5 are photo-micrographs of typical microstructures of high chromium iron samples cast in laboratory sand molds.

FIG. 4 illustrates a typical 500X microstructure of a high chromium iron chemistry falling within the range given herein. This sample was cast in the laboratory in a sand mold; it was shaken out hot at a temperature below the solidus and allowed to cool rapidly to 1400° F., and subsequently furnace cooled at a programmed normal cooling rate for a roll cast in a conventional chill mold. The microstructure, therefore, typifies a form of the prior art. This sample was cooled rapidly through the critical temperature zone, and complex compounds did not precipitate in the matrix phase. This microstructure is composed of a discontinuous massive $M_7C_3$ carbide network which usually are referred to as primary carbides and a matrix where the original solid solution has transformed to pearlite—dark areas—or remained as an austenitic type solid solution phase—light colored areas.

Figure 5:
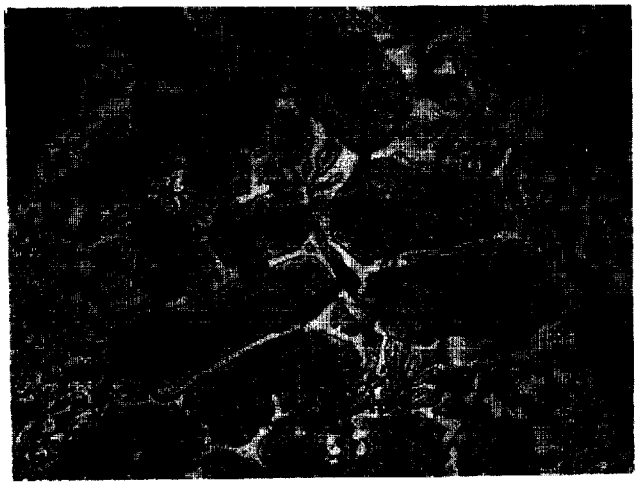

FIG. 5 illustrates a typical 500X microstructure of a high chromium iron of the same chemical analysis and cast in the same manner as the sample shown in FIG. 4. However, after shaking out at a temperature below the solidus, this sample was allowed to cool rapidly to 1760° F. where it was held for 20 minutes and then subsequently furnace cooled at a programmed normal cooling rate for a roll cast in a conventional chill mold. The hold at 1760° F. is within the critical temperature range and allows for the supersaturated solutes to precipitate out in the solid solution matrix as complex compounds of the $M_7C_3$ and $M_{23}C_6$ types. The microstructure is composed of a discontinuous massive $M_7C_3$ carbide network (primary carbides) and a matrix in which a large number of complex compounds of the $M_7C_3$ and $M_{23}C_6$ types have precipitated in the form of small round or geometric shapes. These precipitated complex compounds are seen as small white colored dots in the matrix. A substantial portion of the remaining matrix background is composed of martensite. The darker areas within the matrix is associated with a pearlite aggregate.

A comparison of FIGS. 4 and 5 shows the affect that time in the critical temperature range has on the final as cast microstructure. By allowing for the precipitation of compounds from a solid solution super-saturated with solutes as in FIG. 5, the remaining solid solution achieves a condition that better approaches equilibrium. On subsequent cooling it can then more fully transform in a predictable manner as the case of FIG. 5, to essentially martensite.

FIGS. 6, 7, 8 and 9 show 500X microstructures of actual samples obtained from a 22½"×66" test roll "A" at depths of ¼", ½", ¾" and 1" respectively, from the as cast surface. This test roll was centrifugally cast in a conventional manner and the chill mold temperature was 315° F. The chemical analysis was within the range given hereinafter. The roll was allowed to cool in a normal manner to room temperature.

FIGS. 10, 11, 12 and 13 show 500X microstructures of actual samples obtained from a 22½"×66" test roll "B" at depths of ¼", ½", ¾" and 1" respectively, from the as cast surface. The shell for this roll was centrifugally cast in a conventional manner, however, the chill mold temperature was 550° F. The chemical analysis was the same as the previously mentioned roll and was within the range given herein. The roll was allowed to cool in a normal manner to room temperature.

Figure 6:
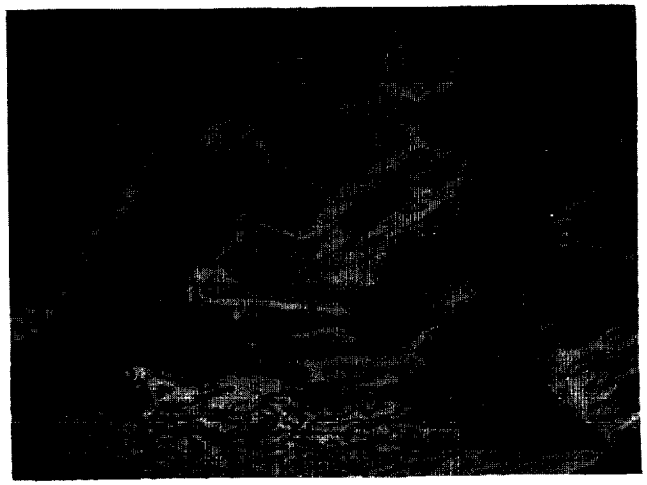
FIGS. 6–13 are photo-micrographs of typical microstructures of the improved roll of the subject invention.
Figure 7:
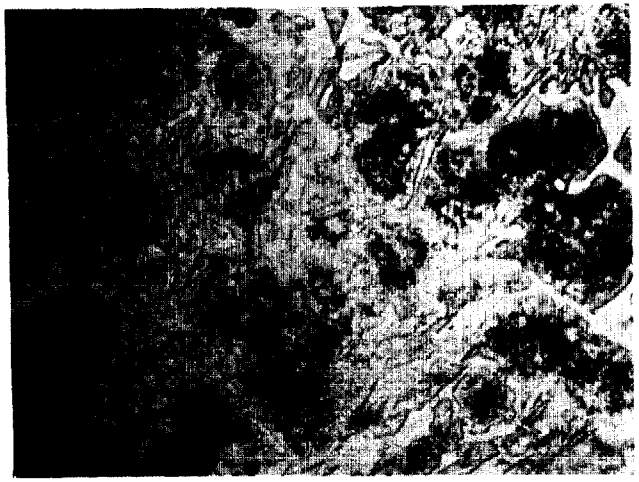
Figure 8:
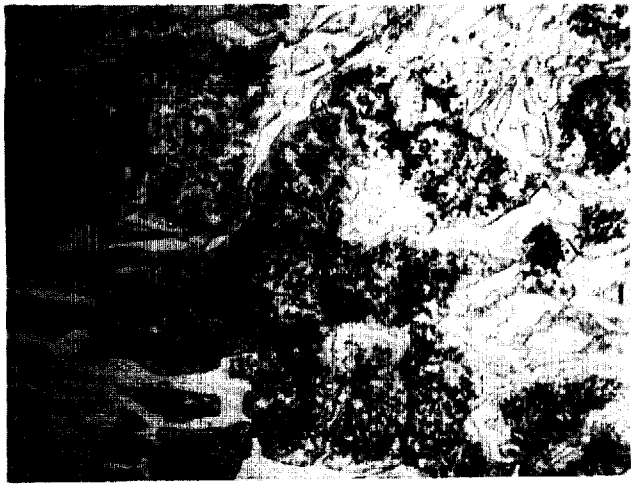
Figure 9:
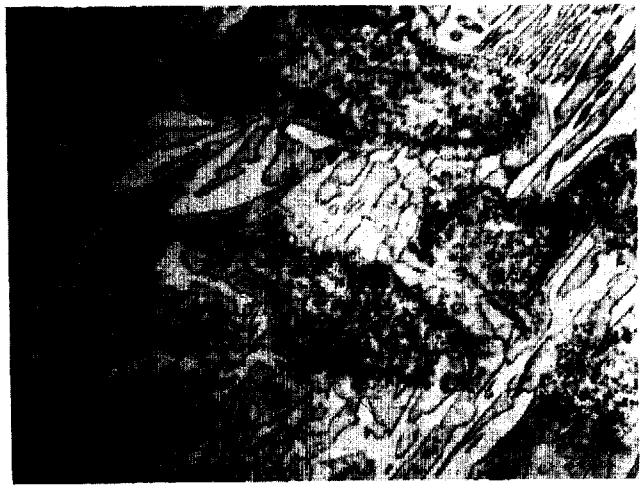
Figure 10:
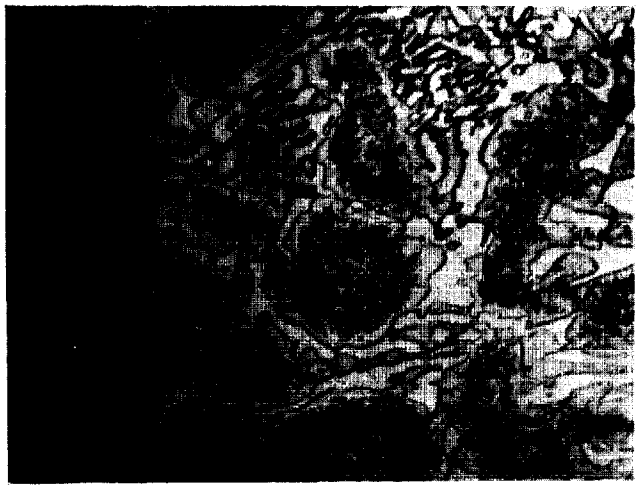
Figure 11:
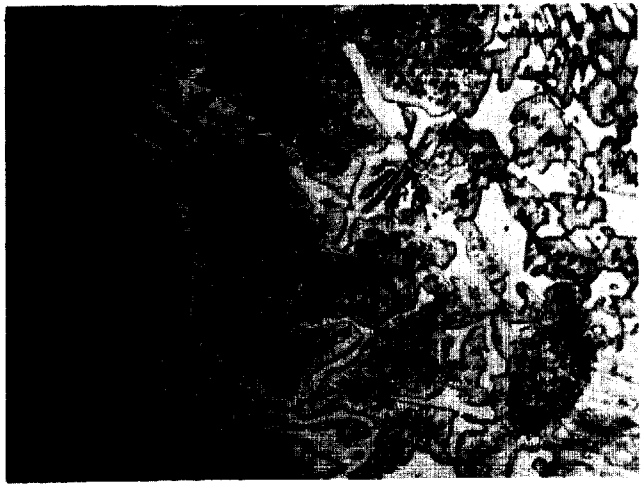
Figure 12:
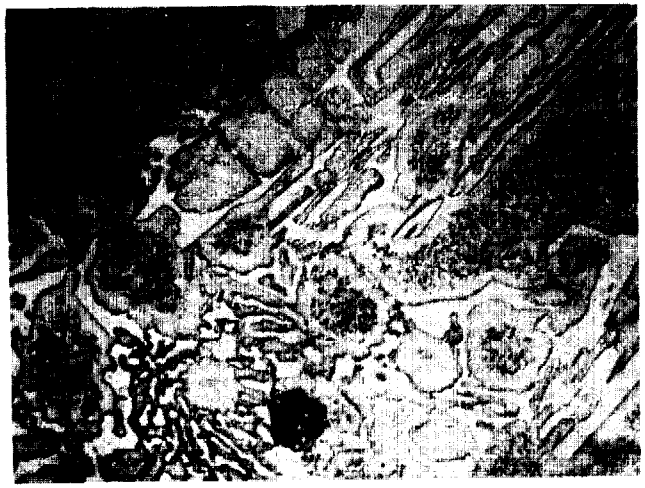
Figure 13:
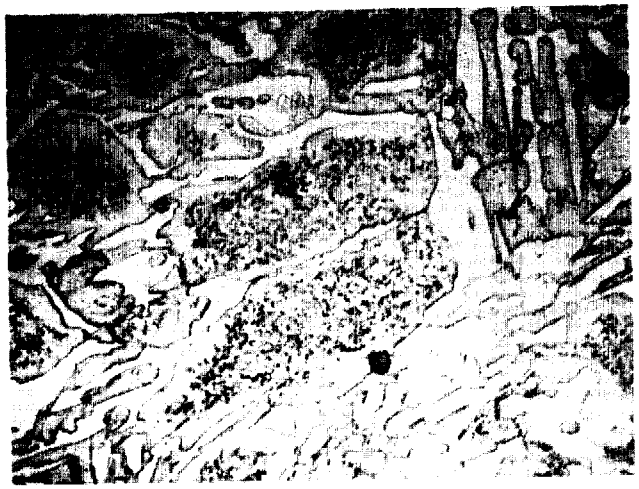

A comparison of the microstructures between test roll "A" and test roll "B" show that test roll "A", FIGS. 6, 7, 8 and 9, has areas with considerable amounts of pearlite aggregate—dark areas—particularly noticeable in FIG. 6 at a depth of ¼" from the as cast surface which for some applications may be desirable. The amount of this pearlite aggregate decreases as depth increases (FIGS. 7, 8 and 9). The presence of precipitated compounds of the $M_7C_3$ and $M_{23}C_6$ types in the matrix become noticeable in FIG. 7 at the ½" depth. The amount of the precipitated compounds increases with depth (FIGS. 8 and 9). Test roll "B" shows essentially similar microstructures at all depths (FIGS. 10, 11, 12 and 13) which for some applications may be highly desirable. The matrix structure at all depths illustrates a predominant dispersement of precipitated compounds of the $M_7C_3$ and $M_{23}C_6$ types with an essentially martensitic background.

Both test rolls "A" and "B" reached the solidus temperature essentially at the same time, however, 7 minutes after passing through the solidus temperature the I.D. temperature of the shell for test roll "A" was 1860° F. The I.D. temperature of the shell for test roll "B" was 2000° F. The different cooling rates of these two shells through the critical temperature range being approximately between 2000° F. and 1600° F. is responsible for the observed differences in the amount of $M_7C_3$ and $M_{23}C_6$ compounds that precipitated from a supersaturated solution in the solid solution matrix phase.

As stated in the objects, the gist of the present invention is to employ a mold that when preheated to a temperature between 300° to 600° F. at the time of pouring the metal into the mold, the mold will control the cooling rate after solidification during a predetermined critical period below the solidus.

A preferred use of the preheating chill of the present invention is in the manufacture of high chromium shells in a rolling mill work roll consisting of the following well known chemical composition: C 2.50 to 3.50; Si. 0.50 to 2.00; S. 0.100 max.; Mn. 0.50 to 2.00; P. 0.400 max.; Ni. 0.50 to 2.50; Cr. 15.00 to 20.00; Mo. 0.50 to 3.00, and the balance being Fe.

Given this chemical composition, the present invention, as stated previously in referring to test rolls "A" and "B", precipitates complex compound of $M_7C_3$ and $M_{23}C_6$ type and both of these exist in the matrix.

It is to be observed that following the teaching of well known metallurgical principles and as previously noted, iron based metal with alloying elements that include carbon and chromium will precipitae complex compounds when in a non-equilibrium condition. These complex compounds are defined as carbide of $M_7C_3$ and/or $M_{23}C_6$ types which combine with multiple elements in the form of carbides.

Figure 2:
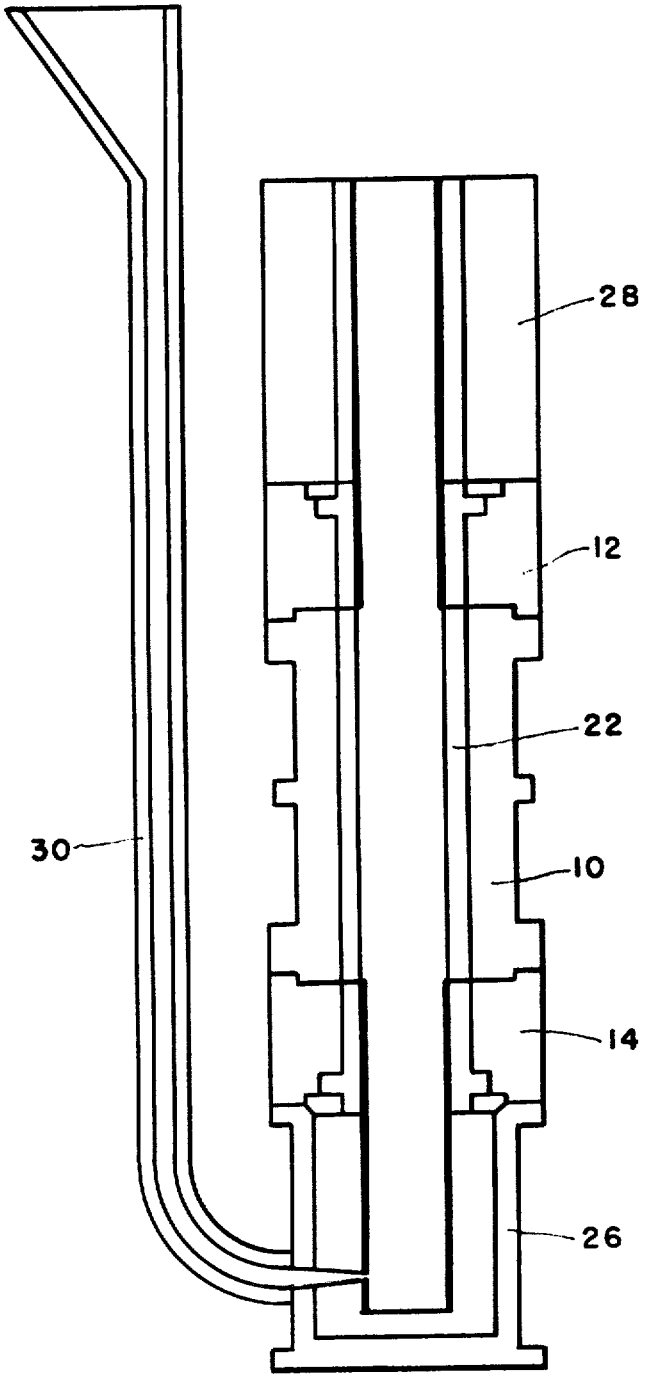
FIG. 2 is a schematic elevational view of the mold assembly employed in FIG. 1, repositioned to a vertical position in preparation for casting of the core after the shell is cast.

In FIG. 2, as already mentioned, the mold assembly assumes a vertical position with the addition of a drag neck 26 and cope neck 28. This assembly illustrates generally a well known manner in which the core of the roll is produced as an integral fused part of the shell. The runner 30 extending parallel to the mold delivers molten metal, which will be one of several chemical compositions well known in the art, to the mold through the drag neck. The manufacture of a composite roll in this fashion is also well known in the roll manufacturing industry, therefore, no further explanation regarding completion of a roll is deemed necessary. It will, however, be appreciated that while for illustrative purposes a horizontal centrifugally casting machine has been referred to, a vertical centrifugally casting machine which is also well known in the art could be employed.

The idealized schematic cooling curves in FIG. 3 and microstructures in FIGS. 6 to 9 and 10–13 illustrate clearly the effect the present invention has on the finished product. The time period the roll shell occupies in the critical temperature range is increased by the application of the principles disclosed in the present invention. As the microstructures in FIGS. 10, 11, 12 and 13 show, rolls manufactured using the principles disclosed can be made to possess a martensitic structure with a predominant dispersement of precipitated complex compounds ($M_7C_3$–$M_{23}C_6$) in the matrix. This improved uniformity in the microstructure allows for the highly desirable combination of strength, toughness and hardness to be achieved for an outer shell of a roll.

The rolls of FIGS. 6–9 and 10–13 both provide a substantial improvement over the prior art in that they can be manufactured without the need of costly heat treatments to obtain desirable microstructures that will increase wear resistance, spall resistance and firecracking resistance.

In accordance with the provisions of the patent statutes, I have explained the principle and operation of my invention and have illustrated and described what I consider to represent the best embodiment thereof.

I claim:

1. An article of manufacture comprising a centrifugally cast shell of an iron base metal for a composite rolling mill roll, said shell in an as cast state having a desirable microstructure produced by heating a chill mold element employed to rapidly solidify the molten metal upon contact therewith to form said shell, said rapid solidification producing the formation of elongated crystals inwardly of the wall of the mold along the working surface of the roll which crystals are composed of primary carbides and an austenitic matrix, the temperature of said mold element being such that in cooling the molten metal from the liquidus temperature to the solidus temperature there remains substantially unchanged the effect of rapid cooling by said chill mold and said formation of elongated crystals formed in said solidification process which is the same general result as that obtained in a cast shell of the same metal produced in a generally identical non-heated mold, but which differs in that said temperature controls and decreases the cooling rate of the metal after said solidification has occurred for only a time period during a critical temperature range of approximately between 1600° and 2000° F. to cause complex carbide compounds to precipitate from the austenitic matrix before any substantial amount of pearlite can be formed, thereby to obtain said desirable microstructure which consists of a substantially martensitic matrix after cooling said article to room temperature.

2. An article of manufacture according to claim 1, wherein said shell is a high alloy and said microstructure is substantially uniform from its outer diameter to its inner diameter.

3. An article of manufacture comprising a cast shell for a composite rolling mill roll, said shell composed of the following percentage range of elements: C2.50 to 3.50; Si 0.50 to 2.00; S 0.100 Max; Mn. 0.50 to 2.00; P 0.400 Max.; Ni. 0.50 to 2.50; Cr. 15.00 to 20.00; Mo. 0.50 to 3.00; and the balance being Fe, and having in an as cast state a desirable microstructure characterized by the dispersement of said elements forming complex compounds produced by heating a chill mold to a temperature such that in cooling the molten metal from the liquidus temperature to the solidus temperature there remains substantially unchanged the effect of rapid cooling by said chill mold and said formation of elongated crystals formed in said solidification process which is the same general result as that obtained in a cast shell of the same metal produced in a generally identical non-heated mold, but which differs in that said temperature controls and decreases the cooling rate of the metal after solidification has occurred for only a time period during a critical temperature range of approximately between 1600° F. and 2000° F. to cause complex carbide compounds to precipitate from the austenitic matrix before any substantial amount of pearlite can be formed, thereby to obtain said desirable microstructure which consists of a substantially martensitic matrix after cooling said article to room temperature.

4. In a method of casting an alloy metallic object such as the shell of a composite rolling mill roll, the steps comprising:

preparing a mold for reception of molten metal having an iron base with alloying elements that include carbon in the range of 2.5 to 3.5% and chromium in the range of 15 to 20% and which when in a non-equilibrium condition precipitate complex compounds, said preparation including the employment of a chill mold element to form at least a part of the cast object and designed to rapidly solidify the metal on contact therewith during said solidification and to control at a given preheating temperature the cooling rate of the casting, said rapid solidification producing the formation of elongated crystals inwardly of the wall of the mold along the working surface of the roll which crystals are composed of a primary carbide and austenitic matrix, pouring said metal into said mold, and prior to said pouring, heating said chill mold element to said preheating temperature such that in cooling the molten metal from the liquidus temperature to the solidus temperature there remains substantially unchanged the effect of rapid cooling by said chill mold and said formation of elongated crystals formed in said solidification process which is the same general result as that obtained in a cast shell of the same metal produced in a generally identical non-heated mold, but which differs in that said temperature controls and decreases the cooling rate of said metal after solidification has occurred for only a time period during a critical temperature range of approximately between 1600° and 2000° F. to cause complex carbide compounds to precipitate from the austenitic matrix before any substantial amount of pearlite can be formed, thereby to obtain a substantially martensitic matrix after cooling said casting to room temperature.

5. A method of casting according to claim 4, wherein the temperature of said chill mold is within the approximate range of 300° to 600° F. when said alloy contacts said chill mold.

6. A method of casting according to claim 4, wherein said object is characterized as having a substantially uniform microstructure from its outer layer to its inner layer.

7. In a method of casting according to claim 4, wherein said molten metal further comprises the following percentage range of elements: 0.50 to 2.00 Si; 0.1 S.; 0.50–2.00 Mn.; 0.40P.; 0.50–2.50 Ni.; 0.50–3.00 Mo.; and the balance being Fe.

8. In a method of casting an alloy metallic object according to claim 4 wherein said complex compounds are of the $M_7C_3$ and $M_{23}C_6$ types.

9. A method of casting according to claim 4, the additional step of rotating said mold at a speed sufficient to centrifugally cast said molten metal against said chill mold element.

* * * * *